US007591252B1

(12) United States Patent
Park

(10) Patent No.: US 7,591,252 B1
(45) Date of Patent: Sep. 22, 2009

(54) GAS VAPOR CONTROL SYSTEM

(75) Inventor: Yong Jung Park, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/269,635

(22) Filed: Nov. 12, 2008

(30) Foreign Application Priority Data

May 8, 2008 (KR) ..... 10-2008-0043039

(51) Int. Cl.
*F02M 33/02* (2006.01)

(52) U.S. Cl. ..... 123/520; 123/519

(58) Field of Classification Search ..... 123/516, 123/518, 519, 520, 179.16
See application file for complete search history.

(56) References Cited

U.S. PATENT DOCUMENTS 5,220,898 A * 6/1993 Kidokoro et al. ..... 123/520
5,357,934 A * 10/1994 Iida et al. ..... 123/520
5,371,412 A * 12/1994 Iwashita et al. ..... 290/1 R
5,465,703 A * 11/1995 Abe ..... 123/674
5,962,927 A * 10/1999 Inada et al. ..... 290/40 R
6,425,365 B1 * 7/2002 Peters et al. ..... 123/198 DB
6,961,654 B2 * 11/2005 Boggs et al. ..... 701/112
7,255,081 B2 * 8/2007 Sieber et al. ..... 123/179.17
2002/0083930 A1 * 7/2002 Robichaux et al. ..... 123/520
2002/0096137 A1 * 7/2002 Kobayashi et al. ..... 123/179.4
2005/0011185 A1 * 1/2005 Annoura et al. ..... 60/289
2007/0117667 A1 * 5/2007 Tamai et al. ..... 475/5

* cited by examiner

*Primary Examiner*—Thomas N Moulis
(74) *Attorney, Agent, or Firm*—Morgan, Lewis & Bockius LLP

(57) ABSTRACT

A gas vapor control system that controls gas vapor that is generated in a fuel tank may include a canister in which the gas vapor is captured, a throttle valve that is mounted in an intake passage through which air passes, a gas vapor passage connecting the fuel tank to a portion of the intake passage formed before the throttle valve, wherein the canister is positioned at the gas vapor passage, a purge control valve that is mounted on the gas vapor passage, and a control portion that stops an engine in an idle stop condition, and that closes the throttle valve and opens the purge control valve to flow the gas vapor into the intake passage when a canister load value (CL) is higher than a predetermined value.

17 Claims, 2 Drawing Sheets

GAS VAPOR CONTROL SYSTEM

CROSS-REFERENCE TO RELATED APPLICATION

The present application claims priority to Korean Patent Application No. 10-2008-0043039 filed on May 8, 2008, the entire contents of which applications is incorporated herein for all purposes by this reference.

BACKGROUND OF THE INVENTION

1. Field of the Invention

The present invention relates to a gas vapor control system, and more particularly to a gas vapor control system for reducing fuel consumption by controlling a gas vapor in an idle stop condition of a vehicle.

2. Description of Related Art

Generally, an idle stop-and-go system stops an engine in an idle state so as to reduce fuel consumption. Also, the engine is restarted without a key operation when the driving will of a driver is detected.

For example, when a vehicle speed is zero and a brake pedal is depressed for 3 seconds, the engine automatically stops, and when the brake pedal is not depressed and the accelerator pedal is depressed or a gear is shifted, the engine is restarted.

Further, a canister includes an absorbent material that can absorb gas vapor from a fuel tank, and when the gas vapor leaks out of a vehicle, exhaust gas regulations are not satisfied.

Accordingly, an engine control unit (ECU) causes the hydrocarbons that are captured in the canister to flow into the engine through a purge control valve.

On the other hand, in a vehicle that is equipped with the idle stop-and-go system, when the amount of gas vapor that is captured in the canister is greater than a predetermined value, the engine is restarted so as to combust the gas vapor in the idle stop condition.

Accordingly, the idle stop period is reduced such that there is problem in that fuel consumption increases. Particularly, when the gas vapor is fully charged in the canister, gas vapor that leaks out pollutes the environment.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a gas vapor control system having advantages of increasing an idle stop period and decreasing fuel consumption by controlling gas vapor that is captured in a canister.

One aspect of the present invention is directed to a gas vapor control system that controls gas vapor that is generated in a fuel tank, the system including a canister in which gas vapor is captured, a throttle valve that is mounted in an intake passage through which air passes, a gas vapor passage connecting the fuel tank to a portion of the intake passage displaced before the throttle valve, wherein the canister is positioned at the gas vapor passage, a purge control valve that is mounted on the gas vapor passage, and/or a controller that stops an engine in an idle stop condition, and that closes the throttle valve and opens the purge control valve to flow the gas vapor of the canister into the intake passage when a canister load value (CL) is higher than a predetermined value.

The predetermined value (CL) of the canister load value may be approximately 0.9. The purge control valve may be displaced at the gas vapor passage between the canister and the portion of the intake passage displaced before the throttle valve. The controller may open the closed throttle valve after a first predetermined time period determined according to a variation amount of the canister load value (CL), and may restart the engine after closing the opened purge control valve. The variation amount of the canister load value (CL) may be calculated through a pressure change of gas vapor that may be detected by a fuel pressure sensor mounted on the fuel tank.

The canister load value (CL) may be lower than the predetermined value, the controller may sustain engine stop for a second predetermined time period determined according to the variation amount of the canister load value (CL). The variation amount of the canister load value may be calculated through a pressure change of gas vapor that may be detected by a fuel pressure sensor mounted on the fuel tank. The controller may close the purge control valve so as to not flow the gas vapor into the engine when the idle stop condition is satisfied and the canister load value is lower than the predetermined value.

The purge control valve may be displaced at the gas vapor passage between the canister and the portion of the intake passage displaced before the throttle valve. The controller opens the closed throttle valve after a first predetermined time period determined according to a variation amount of the canister load value (CL), and restarts the engine after closing the opened purge control valve. The variation amount of the canister load value (CL) may be calculated through a pressure change of gas vapor that may be detected by a fuel pressure sensor mounted on the fuel tank. When the canister load value (CL) is lower than the predetermined value, the controller may sustain engine stop for a second predetermined time period determined according to the variation amount of the canister load value (CL).

A passenger vehicle may include any of the engines described above.

A passenger vehicle may any of the gas vapor control systems described above. The purge control valve may be displaced at the gas vapor passage between the canister and the portion of the intake passage displaced before the throttle valve. The controller may open the closed throttle valve after a first predetermined time period determined according to a variation amount of the canister load value (CL), and restarts the engine after closing the opened purge control valve. The variation amount of the canister load value (CL) may be calculated through a pressure change of gas vapor that may be detected by a fuel pressure sensor mounted on the fuel tank. When the canister load value (CL) is lower than the predetermined value, the controller may sustain engine stop for a second predetermined time period determined according to the variation amount of the canister load value (CL).

Another aspect of the present invention is directed to a gas vapor control method that includes providing a canister in which the gas vapor may be captured, a throttle valve that is mounted in an intake passage through which air passes, a gas vapor passage connecting a fuel tank to a portion of the intake passage displaced before the throttle valve, wherein the canister may be positioned at the gas vapor passage, and a purge control valve that may be mounted on the gas vapor passage so as to control gas vapor and to flow the gas vapor into the intake passage, the method may further include detecting an engine stop in an idle stop condition of an engine, detecting a canister load value (CL), comparing the canister load value (CL) with a predetermined value, and/or closing the throttle valve and opening the purge control valve when the canister load value (CL) may be higher than the predetermined value.

The predetermined value may be approximately 0.9. The closed throttle valve may be opened after a first predetermined time period determined according to a variation amount of the canister load value (CL), and the engine may be restarted after closing the opened purge control valve. The variation amount of the canister load value may be calculated through a pressure change of gas vapor that may be detected by a fuel pressure sensor that may be mounted on the fuel tank. The engine stop may be sustained for a second predetermined time period determined according to a variation amount of the canister load value, when the canister load value (CL) may be lower than the predetermined value. The variation amount of the canister load value may be calculated through a pressure change of gas vapor that may be detected by a fuel pressure sensor that may be mounted on the fuel tank.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
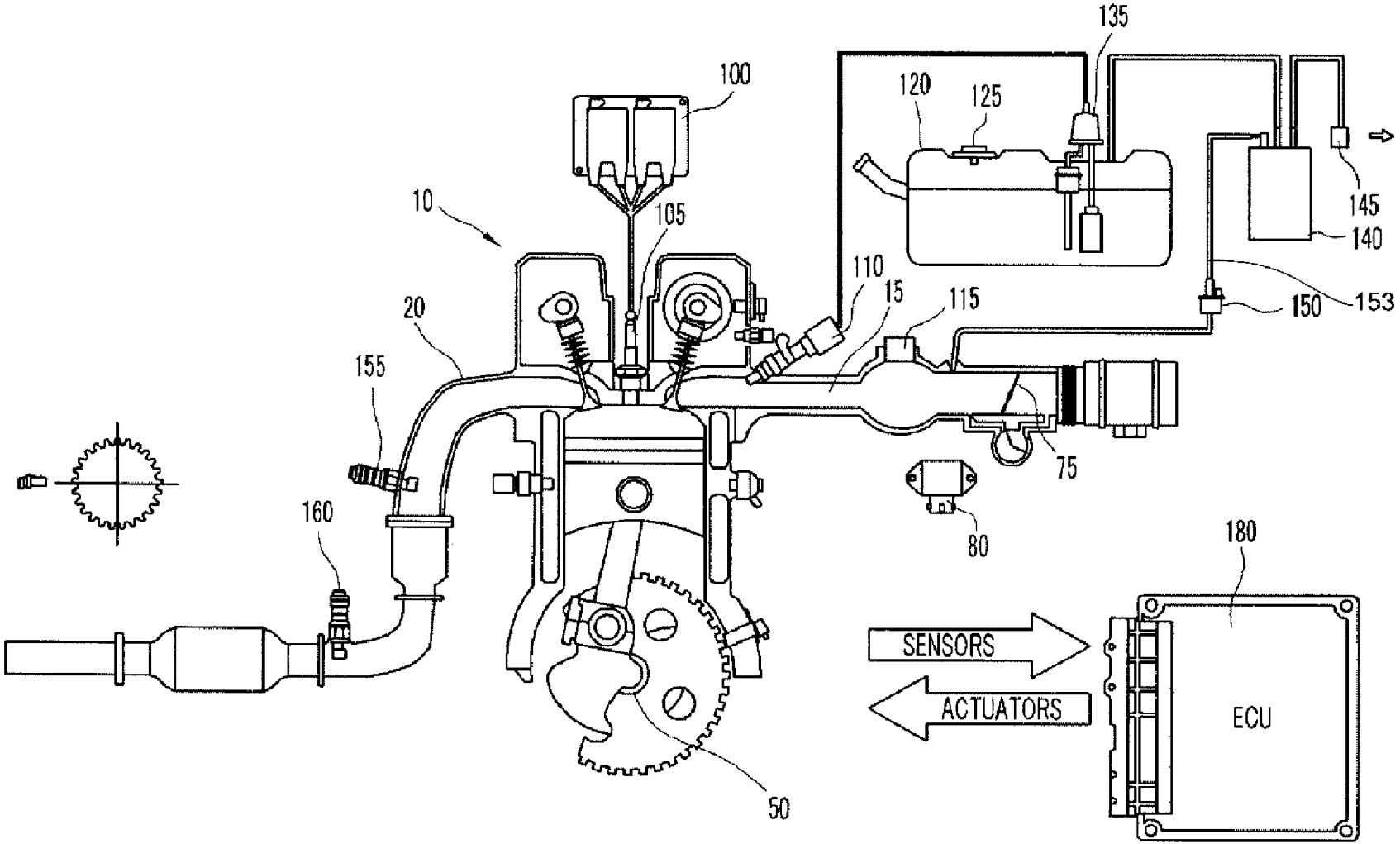
FIG. 1 is a schematic diagram of an exemplary gas vapor control system in accordance with the present invention.

FIG. 1 is a schematic diagram of a gas vapor control system according to an exemplary embodiment of the present invention.

Referring to FIG. 1, an engine 10 includes an intake passage 15, a throttle valve (ETC, 75), a throttle opening rate sensor 80, a manifold pressure sensor 115, an injector 110, an exhaust passage 20, a crankshaft 50, a distributor 100, a spark plug 105, and oxygen sensors 155 and 160.

Also, a fuel tank 120, a fuel pressure sensor 125, a fuel pump 135, a canister 140, a close valve 145, and a purge control valve (PCV) 150 are disposed adjacent to the engine 10. Further, a control portion or controller 180 that includes a program for controlling the above constituent elements is mounted.

The throttle valve 75 and the opening rate sensor 80 detecting a position of the throttle valve 75 are disposed in the intake passage 15, and the manifold pressure sensor (DTP) 115 for sensing internal pressure is disposed downstream of the throttle valve 75.

The injector 110 for injecting fuel is adjacent to the cylinder, and the oxygen sensors 155 and 160 for sensing oxygen of the exhaust gas are disposed in the exhaust passage 20 of the rear portion of the cylinder.

A fuel pump 135 is disposed at the fuel tank 120 so as to supply the injector 110 with fuel, and a fuel pressure sensor 125 is disposed at the fuel tank 120 so as to detect the inside pressure thereof.

A gas vapor passage 153 through which the gas vapor that is evaporated from the fuel of the fuel tank 120 passes is formed, and the gas vapor passage 153 is connected to the intake passage 15. Further, the canister 140 is mounted substantially at the middle of the gas vapor passage 153.

The purge control valve 150 for controlling the gas vapor that is supplied to the intake passage 15 is disposed in the rear end portion of the canister 140.

The purge control valve 150 is controlled by the control portion 180 according to the gas vapor amount that is captured in the canister 140, and supplies the intake passage 15 with the gas vapor.

The close valve 145 is closed so as to prevent the gas vapor from spreading to the atmosphere in a normal condition, and is opened in an emergency.

The canister load value (CL) is calculated based on a density of the gas vapor that passes through the purge control valve 150 and is included in the intake passage 15 in the present exemplary embodiment in which the idle stop-and-go system is applied.

That is, the control portion 180 calculates the canister load value (CL) based on a ratio of the fuel that is included in the gas vapor that flows into the intake passage 15 through the purge control valve 150.

For example, the manifold pressure sensor (MAP, 115) senses an absolute pressure of the intake passage 15, and the control portion 180 can more accurately calculate the canister load value (CL) based on the absolute pressure, volume, and temperature data. Also, the canister load value (CL) can be calculated based on an intake air amount, a gas vapor inflow amount by an opening of the purge control valve 150, and a fuel/air ratio.

That is, if there is no gas vapor in the canister 140, the canister load value becomes 0, and if the canister 140 is full of the gas vapor, the canister load value becomes 1.

When the canister load value (CL) is higher than a predetermined value (e.g. 0.9), the gas vapor may spread to the air. Accordingly, the engine may be restarted in the idle stop condition so as to prevent environmental pollution caused by the gas vapor spreading out the air.

According to an exemplary embodiment of the present invention, although the canister load value is higher than a predetermined value of 0.9 in an idle stop condition, the engine 10 is not restarted but the purge control valve 150 is opened such that the gas vapor that is captured in the canister 140 is supplied into the intake passage 15. At this time, the throttle valve 75 is completely closed such that the gas vapor does not be spread out to the air. Accordingly, the idle stop period is extended, and thereby fuel consumption decreases.

Generally, the idle stop-and-go system is normally operated when the vehicle speed is lower than 3 km/h, the engine is in an idle condition, the gear is in a neutral position, and the clutch is released.

Further, the idle stop-and-go system is not operated when the operating switch is off, the SOC value of the battery is lower than a predetermined value, the safety belt is not worn, the door is open, the hydraulic pressure for braking is low, or one of the related sensors and switches breaks down.

The engine is restarted in the idle stop condition when the clutch is depressed in a normal condition, the vehicle speed is higher than 10 km/hr and the gear is neutral, or the hydraulic pressure for braking becomes lower.

In the idle stop-and-go system, a crank angle sensor is disposed so as to reduce a starting time when the engine is restarted, and a battery sensor is mounted so as to detect a charging condition and performance thereof. Further, the operating switch that is manipulated by the driver is prepared, and the display portion is disposed in the cluster so as to notify an operating condition of the idle stop-and-go system.

Also, a neutral switch for sensing a neutral condition of the gear and a position detecting switch for sensing a position of the clutch pedal are disposed.

An Absorbed Glass Mat (AGM) type of battery is applied so as to improve durability the battery. Further, it is desirable that a durable start motor and generator are used.

Figure 2:
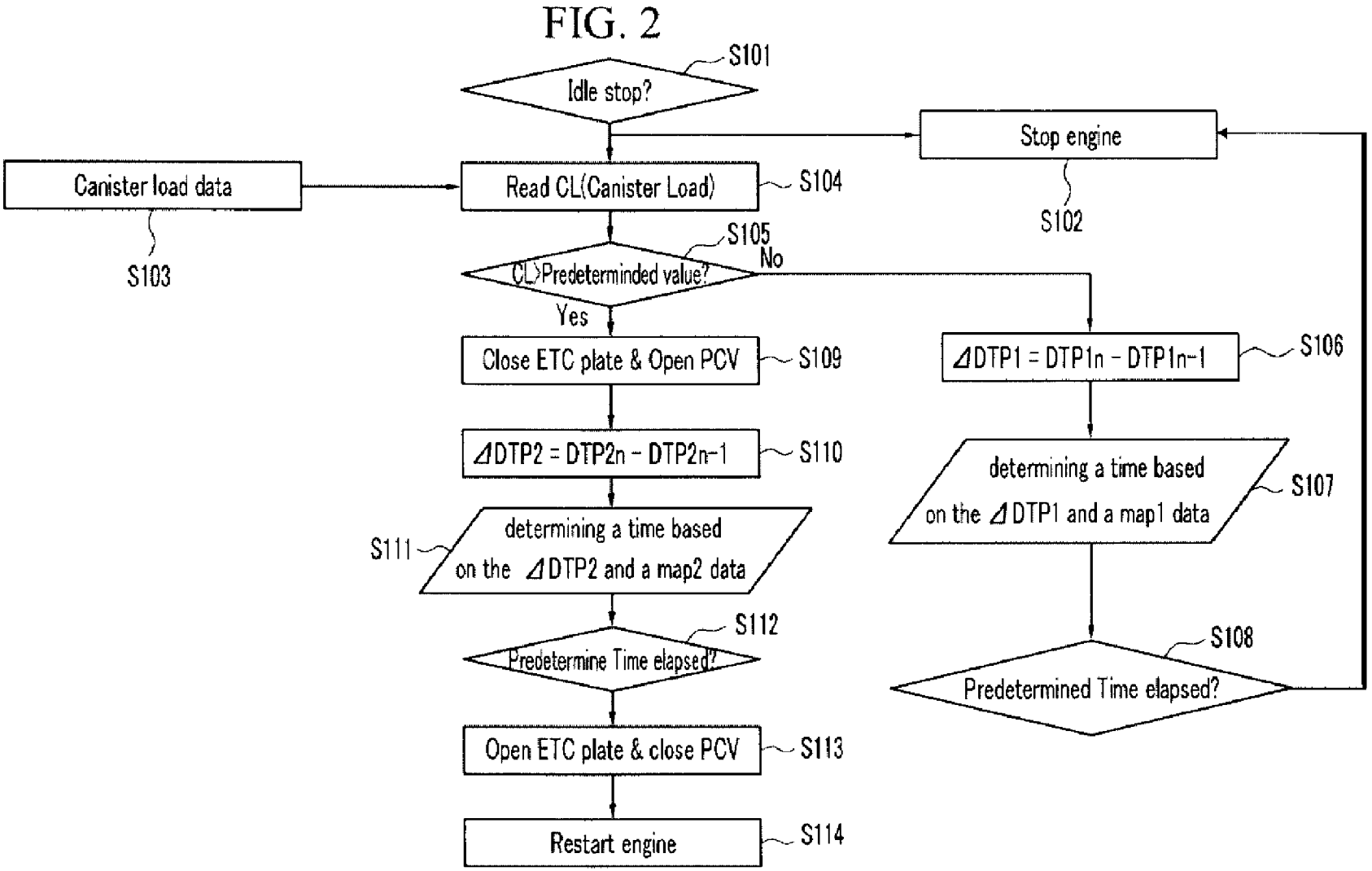
FIG. 2 is a flow chart showing an exemplary gas vapor control method in accordance with the present invention.

FIG. 2 is a flow chart showing a gas vapor control method according to an exemplary embodiment of the present invention.

Referring to FIG. 2, in a first step S101, it is determined whether the idle stop condition is met or not. When the idle stop condition is determined, the engine is stopped in a second step S102, and the canister load value (CL) is detected according to the gas vapor amount that is captured in the canister 140 in third and fourth steps S103 and S104.

The control portion 180 determines whether the canister load value (CL) is higher than a predetermined value (for example, 0.9) in a fifth step S105. When the canister load value (CL) is smaller than the predetermined value in the fifth step S105, the pressure change rate of gas vapor (ΔDTP1) of the gas vapor is calculated by the control portion 180 from fuel pressure in the fuel tank 125 detected by the fuel pressure sensor 125 that is mounted on the fuel tank 125 in a sixth step S106. DTP1*n* and DTP1*n*−1 illustrate fuel pressure at time n and time n−1, i.e., a pressure data sequentially detected by a time difference.

Thereafter, a first map data map1 is selected according to the pressure change rate of gas vapor (ΔDTP1) in the seventh step S107. Also, it is determined whether a predetermined time has elapsed or not according to the first map data map1 in the eighth step S108. When the predetermined time passes, the steps S8101, 102, S103, S104 and S105 are repeated.

Again, the control portion 180 determines that the canister load value (CL) is higher than the predetermined value in the fifth step S105, the throttle valve 75 is closed and the purge control valve 150 is opened in the ninth step S109 such that the gas vapor flows into the intake passage 15.

The pressure change rate of gas vapor (ΔDTP2) of the gas vapor is calculated by the control portion 180 from fuel pressure in the fuel tank 125 detected by the fuel pressure sensor 125 that is mounted on the fuel tank 120 in a tenth step S110. Second map data map2 is selected according to the pressure change rate of gas vapor (ΔDTP2) in an eleventh step S111. Also, it is determined whether a predetermined time has elapsed or not according to the second map data map2 in a twelfth step S112.

In the predetermined time, the throttle valve 75 is opened and the purge control valve 150 is closed in a thirteenth step S113, and the engine is restarted in a fourteenth step S114.

The intake passage 15 is almost full of the gas vapor in the eighth and the twelfth steps S108 and S112, and the gas vapor amount that is captured in the canister 140 is also in a high range.

Also, the throttle valve 75 is electrically controlled through the control portion 180 and the throttle opening rate sensor 80, and the purge control valve 150 is controlled to be opened/closed by the control portion.

For convenience in explanation and accurate definition in the appended claims, the terms "rear", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A gas vapor control system that controls gas vapor that is generated in a fuel tank, the system comprising:

a canister in which gas vapor is captured;

a throttle valve that is mounted in an intake passage through which air passes;

a gas vapor passage connecting the fuel tank to a portion of the intake passage displaced before the throttle valve, wherein the canister is positioned at the gas vapor passage;

a purge control valve that is mounted on the gas vapor passage; and a controller that stops an engine in an idle stop condition, and that closes the throttle valve and opens the purge control valve to flow the gas vapor of the canister into the intake passage when a canister load value (CL) is higher than a predetermined value.

2. The gas vapor control system of claim 1, wherein the predetermined value (CL) of the canister load value is approximately 0.9.

3. The gas vapor control system of claim 1, wherein the purge control valve is displaced at the gas vapor passage between the canister and the portion of the intake passage displaced before the throttle valve.

4. The gas vapor control system of claim 1, wherein the controller opens the closed throttle valve after a first predetermined time period determined according to a variation amount of the canister load value (CL), and restarts the engine after closing the opened purge control valve.

5. The gas vapor control system of claim 4, wherein the variation amount of the canister load value (CL) is calculated through a pressure change of gas vapor that is detected by a fuel pressure sensor mounted on the fuel tank.

6. The gas vapor control system of claim 1, wherein when the canister load value (CL) is lower than the predetermined value, the controller sustains engine stop for a second predetermined time period determined according to the variation amount of the canister load value (CL).

7. The gas vapor control system of claim 6, wherein the variation amount of the canister load value is calculated through a pressure change of gas vapor that is detected by a fuel pressure sensor mounted on the fuel tank.

8. The gas vapor control system of claim 1, wherein the controller closes the purge control valve so as to not flow the gas vapor into the engine when the idle stop condition is satisfied and the canister load value is lower than the predetermined value.

9. An engine comprising the gas vapor control system of claim 1, wherein the purge control valve is displaced at the gas vapor passage between the canister and the portion of the intake passage displaced before the throttle valve, wherein the controller opens the closed throttle valve after a first predetermined time period determined according to a variation amount of the canister load value (CL), and restarts the engine after closing the opened purge control valve, wherein the variation amount of the canister load value (CL) is calculated through a pressure change of gas vapor that is detected by a fuel pressure sensor mounted on the fuel tank, and wherein when the canister load value (CL) is lower than the predetermined value, the controller sustains engine stop for a second predetermined time period determined according to the variation amount of the canister load value (CL).

10. A passenger vehicle comprising the engine of claim 9.

11. A passenger vehicle comprising the gas vapor control system of claim 1, wherein the purge control valve is displaced at the gas vapor passage between the canister and the portion of the intake passage displaced before the throttle valve, wherein the controller opens the closed throttle valve after a first predetermined time period determined according to a variation amount of the canister load value (CL), and restarts the engine after closing the opened purge control valve, wherein the variation amount of the canister load value (CL) is calculated through a pressure change of gas vapor that is detected by a fuel pressure sensor mounted on the fuel tank, and wherein when the canister load value (CL) is lower than the predetermined value, the controller sustains engine stop for a second predetermined time period determined according to the variation amount of the canister load value (CL).

12. A gas vapor control method that includes:

providing a canister in which the gas vapor is captured, a throttle valve that is mounted in an intake passage through which air passes, a gas vapor passage connecting a fuel tank to a portion of the intake passage displaced before the throttle valve, wherein the canister is positioned at the gas vapor passage, and a purge control valve that is mounted on the gas vapor passage so as to control gas vapor and to flow the gas vapor into the intake passage;

detecting an engine stop in an idle stop condition of an engine;

detecting a canister load value (CL);

comparing the canister load value (CL) with a predetermined value; and closing the throttle valve and opening the purge control valve when the canister load value (CL) is higher than the predetermined value.

13. The gas vapor control system of claim 12, wherein the predetermined value is approximately 0.9.

14. The gas vapor control method of claim 12, wherein the closed throttle valve is opened after a first predetermined time period determined according to a variation amount of the canister load value (CL), and the engine is restarted after closing the opened purge control valve.

15. The gas vapor control method of claim 14, wherein the variation amount of the canister load value is calculated through a pressure change of gas vapor that is detected by a fuel pressure sensor that is mounted on the fuel tank.

16. The gas vapor control method of claim 12, wherein the engine stop is sustained for a second predetermined time period determined according to a variation amount of the canister load value, when the canister load value (CL) is lower than the predetermined value.

17. The gas vapor control method of claim 16, wherein the variation amount of the canister load value is calculated through a pressure change of gas vapor that is detected by a fuel pressure sensor that is mounted on the fuel tank.

* * * * *